US005522010A

United States Patent [19]

Toyama

[11] Patent Number: 5,522,010

[45] Date of Patent: May 28, 1996

[54] PITCH CONTROL APPARATUS FOR SETTING COEFFICIENTS FOR CROSS-FADING OPERATION IN ACCORDANCE WITH INTERVALS BETWEEN WRITE ADDRESS AND A NUMBER OF READ ADDRESSES IN A SAMPLING CYCLE

[75] Inventor: Soichi Toyama, Tokyo, Japan

[73] Assignee: Pioneer Electronic Corporation, Tokyo, Japan

[21] Appl. No.: 425,226

[22] Filed: Apr. 18, 1995

Related U.S. Application Data

[63] Continuation of Ser. No. 794,260, Nov. 19, 1991, abandoned.

[30] Foreign Application Priority Data

Mar. 26, 1991 [JP] Japan ..... 3-061918
Mar. 27, 1991 [JP] Japan ..... 3-062982

[51] Int. Cl.[6] ..... G10L 3/02

[52] U.S. Cl. ..... 395/2.16; 395/2.74; 395/800; 395/2.16; 84/604

[58] Field of Search ..... 345/800, 2.16; 381/38, 49

[56] References Cited

U.S. PATENT DOCUMENTS

| | | | |
|---|---|---|---|
| 4,569,268 | 2/1986 | Futamase et al. | 84/626 |
| 4,734,795 | 3/1988 | Fukami et al. | 360/8 |
| 4,792,975 | 12/1988 | Mackay | 395/2 |
| 5,065,433 | 11/1991 | Ida et al. | 381/63 |
| 5,131,042 | 7/1992 | Oda | 381/34 |
| 5,201,005 | 4/1993 | Matsushita et al. | 381/63 |
| 5,262,582 | 11/1993 | Hanzawa et al. | 84/605 |
| 5,367,118 | 11/1994 | Iwaojli | 84/604 |
| 5,369,725 | 11/1994 | Iizuka et al. | 395/2.16 |

FOREIGN PATENT DOCUMENTS

| | | |
|---|---|---|
| 4289900 | 10/1992 | Japan . |
| 4-372773 | 12/1992 | Japan . |
| 4372773 | 12/1992 | Japan . |
| 6-44747 | 2/1994 | Japan . |

*Primary Examiner*—Parshotam S. Lall
*Assistant Examiner*—Kenneth R. Coulter
*Attorney, Agent, or Firm*—Sughrue, Mion, Zinn, Macpeak & Seas

[57] ABSTRACT

A pitch control apparatus which suppresses the occurrence of a tremolo tone which the interval control is performed. Input audio signal data is written at a memory position at a designated writing address in a memory in a predetermined order for every sampling cycle, a plurality of reading addresses of the memory are designated for every sampling cycle, and are set in a different order from the predetermined order for each cycle which is a multiple of the sampling cycle by a predetermined multiplier, data is read from memory positions of designated plurality of reading addresses in the memory, a coefficient is set in accordance with an address interval between the writing address and each of the designated plurality of reading addresses in the memory, the data read out at the plurality of reading addresses are multiplied by the associated coefficients, and the results are added together as output data. The maximum value of interval between each of the plurality of reading addresses, Dmax, is set as $$Dmax=Tdmax/\{(1-(1/Jn))\cdot T_0\}$$

when the pitch is to be raised, and set as $$Dmax=Tdmax/\{(1+(1/Jn))\cdot T_0\}$$

when the pitch is to be lowered, where $T_0$ denotes the sampling cycle of the input audio signal data, Jn denotes how may times a cycle for skipping sampling data or reading sampling data twice should be longer than the sampling cycle $T_0$, and Tdmax denotes an allowable time for a time-dependent data shift between the plurality of reading addresses, and the allowable time is set 45 to 80 msec by which the reverberation phenomenon is not remarkably disturbing.

8 Claims, 7 Drawing Sheets

RING BUFFER MEMORY
9
3
MEMORY CONTROLLER
DATA MEMORY
RAM
22
12
17
28
BUFFER MEMORY
BUFFER MEMORY
16
14
MULTIPLIER
15
DISCRIMINATOR
FLAG REGISTER
18
25
26
TIMING SIGNALS
ALU
SEQUENCE CONTROLLER
19
ACCUMULATOR
20
MEMORY CONTROLLER
PROGRAM MEMORY
27
24
13
23
INTERFACE
INTERFACE
INPUT
OUTPUT
MICROCOMPUTER
KEYBOARD
8

START
S1
INITIALIZATION
S2
WRITE INPUT DATA AT MEMORY POSITION SPECIFIED BY ADDRESS W
S3
M ← 0
Do ← 0
S4
M < N
NO
YES
S5
M ← M + 1
NO
RESIDUAL OF n/Jn IS "0" ?
S6
YES
RMn ← RMn-1 + UD
dRMn ← dRMn-1 + UD
S8
dRMn > 0
NO
S9
YES
S10
dRMn < Bs
NO
S7
n = 0
YES
YES
NO
aM ← f (dRMn)
S11
Do ← Do + aM · (* RMn)
S12
S15
OUTPUT DATA Do
S16
PITCH CONTROL PROCESS SHOULD BE ENDED ?
YES
NO
S17
n ← n + 1
END
RMn ← W + Bs
dRMn ← B
S13
S14
RMn ← W
dRMn ← 0

PITCH CONTROL APPARATUS FOR SETTING COEFFICIENTS FOR CROSS-FADING OPERATION IN ACCORDANCE WITH INTERVALS BETWEEN WRITE ADDRESS AND A NUMBER OF READ ADDRESSES IN A SAMPLING CYCLE

This is a File Wrapper Continuation of application No. 07/794,260 which was filed on Nov. 19, 1991 now abandoned.

BACKGROUND OF THE INVENTION

1. Field of the Invention

The present invention relates to a pitch control apparatus, and, more particularly, to a pitch control apparatus which changes the frequency of an audio signal to a desired frequency so as to effect a pitch control between an original musical tone and a reproduced musical tone.

2. Description of Background Information

There are some conventional pitch control apparatuses configured to write data, which is obtained by sampling an analog input signal, sequentially into a ring buffer memory, read data in a different cycle from a writing cycle, and sequentially demodulate the read data, thus changing the pitch of the signal. Such a pitch control apparatus controls the amount of read-out data in the following manner. If a cycle for reading data from the ring buffer memory is longer than the writing cycle (i.e., in the case of lowering the pitch), data stored in the buffer memory is read, partially overlapping the previously read data, by every predetermined period. If the data-reading cycle is shorter than the writing cycle (i.e., in the case of raising the pitch), on the other hand, some data is skipped and the succeeding data is read out. If both the reading cycle and the writing cycle are variable, skipping data or reading data twice is not necessary. If the contents of the data, when being skipped or read out twice, have less relativity to those of the previous or succeeding data, discontinuous points would occur in a musical tone to be reproduced. A so-called cross-fading technique is used to reduce these deficiencies. In the case that the reading cycle is shorter than the writing cycle, the difference between a write point W and a read point R of the ring buffer memory, $d_{R-W}$, is usually greater than a predetermined value $d_{th}$, as shown in FIG. 1A. It is assumed that both points advance clockwise. When $d_{R-W}<d_{th}$, data is read out at a point R', away clockwise from the read point R by the predetermined value $d_{th}$, as shown in FIG. 1B, a fade-out process is linearly performed on the read data at the read point R, and a fade-in process is performed on the data at the read point R'. These pieces of data are then added together, realizing the cross-fading.

Since the number of read points changes from one to two in the cross-fade period, however, depending on the frequency components of a signal, their phases may become opposite to each other to be canceled out, or the frequency components, when in phase, raise their levels. This causes a large time-dependent change in the frequency response as shown in FIG. 2, causing a problem of generating a so-called tremolo tone.

The larger the size or the memory capacity of the ring buffer memory, the greater the predetermined value $d_{th}$ can be set. With a larger memory size, the number of dips for the frequency response in FIG. 2 increases, while the interval between the dips and the width of the dip itself become narrower. Since the probability of the frequency of an audio signal being equal to that of the dips becomes lower, therefore, the occurrence of tremolo tones is considered to be suppressed.

Even if intervals between a plurality of read points can be set wide, however, the time duration between pieces of data to be read out becomes larger. This causes a reverberation phenomenon. For example, in the case of the sound of a percussion or the like, one beat in the original tone appears to sound two or more beats after the pitch control. While this reverberation phenomenon occurs only during the cross-fade in the conventional pitch control apparatus, in a pitch control apparatus which is configured to always designate a plurality of read points in the ring buffer memory to read data therefrom, and multiply each piece of the read data by a coefficient and then add them together to acquire output data, however, the reverberation phenomenon would always occur if the ring buffer memory has a large memory capacity.

OBJECT AND SUMMARY OF THE INVENTION

It is therefore an object of the present invention to provide a pitch control apparatus which suppresses the occurrence of tremolo sounds.

It is another object of the present invention to provide a pitch control apparatus which can suppress the occurrence of tremolo sounds and a reverberation phenomenon.

An interval control apparatus according to one aspect of the present invention comprises writing address designating means for designating a writing address of a memory in a predetermined order for every sampling cycle for an input audio signal data; reading address designating means for designating a plurality of reading addresses of the memory for every sampling cycle, and setting the plurality of reading addresses in a different order from the predetermined order for each cycle which is the sampling cycle multiplied by a predetermined multiplier; means for writing the input audio signal data at a memory position at the designated writing address in the memory; means for reading data from memory positions at the designated plurality of reading addresses in the memory; means for setting a coefficient in accordance with an address interval between the writing address and each of the designated plurality of reading addresses in the memory; and calculating means for multiplying data read out at the plurality of reading addresses by the associated coefficients, and adding resultant data together as output data.

Since the coefficient is set in accordance with the interval between the writing address and each reading address in the above pitch control apparatus, even though the values of data resulting from the multiplication of individual pieces of read data by the coefficients are added to provide output data, a change in the time-dependent frequency response can be made smaller, suppressing the generation of tremolo sound.

A pitch control apparatus as another aspect of the present invention comprises writing address designating means for designating a writing address of a memory in a predetermined order for every sampling cycle $T_0$ for an input audio signal data; reading address designating means for individually designating a plurality of reading addresses of the memory in a predetermined order for every sampling cycle $T_0$, setting the plurality of reading addresses at addresses of at least one sampling cycle $T_0$ after, when the pitch is to be raised, and setting the plurality of reading addresses at addresses of at least one sampling cycle $T_0$ before when the pitch is to be lowered, in either case for every cycle which is a multiple of sampling cycle $T_0$ by a predetermined multiplier Jn (an integer of 2 or larger); means for writing the input audio signal data at a memory position at the designated writing address in the memory; means for reading data from memory positions at the designated plurality of reading addresses in the memory; means for setting a coefficient in accordance with an interval between the writing address and each of the designated plurality of reading addresses in the memory; and calculating means for multiplying data read out at the plurality of reading addresses by the associated coefficients, and adding resultant data together as output data; with an allowable time for a time-dependent data shift between the plurality of reading addresses being denoted by Tdmax, a maximum value of an interval between each of the plurality of reading addresses, Dmax, being set as $$Dmax=Tdmax/\{(1-(1/Jn))\cdot T_0\}$$

when the pitch is to be raised, and set as $$Dmax=Tdmax/\{(1+(1/Jn))\cdot T_0\}$$

when the pitch is to be lowered, and the allowable time being set to 45 to 80 msec.

DETAILED DESCRIPTION OF THE PREFERRED EMBODIMENT

A preferred embodiment of the present invention will now be described referring to the accompanying drawings.

Figure 1A:
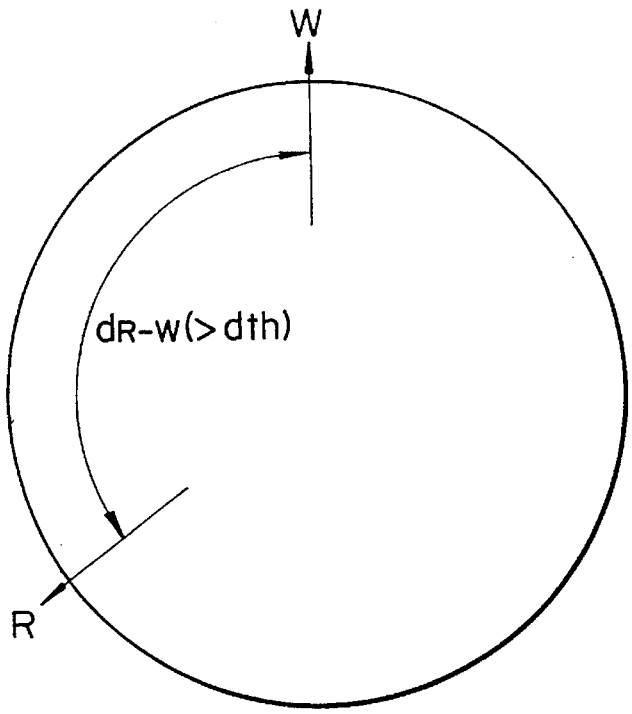
FIGS. 1A and 1B are diagrams illustrating the positional relation between a writing address and reading addresses in a ring buffer memory in a conventional pitch control apparatus.
Figure 1B:
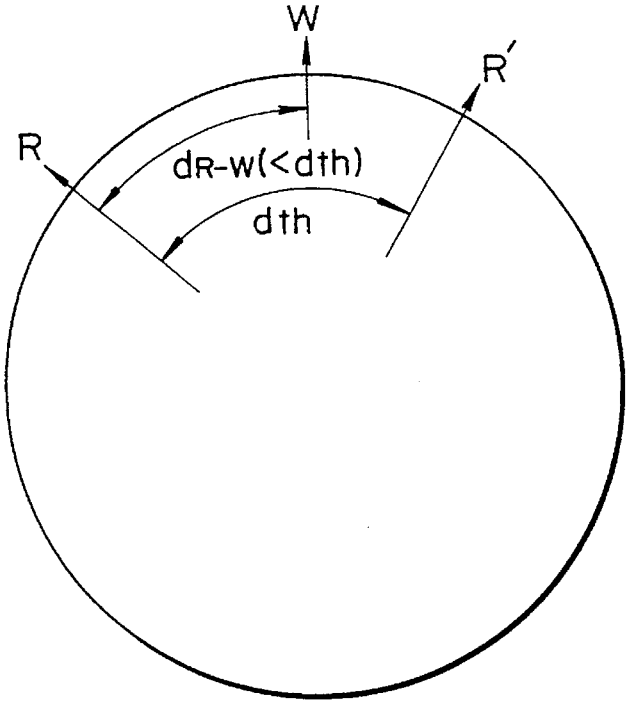
Figure 2:
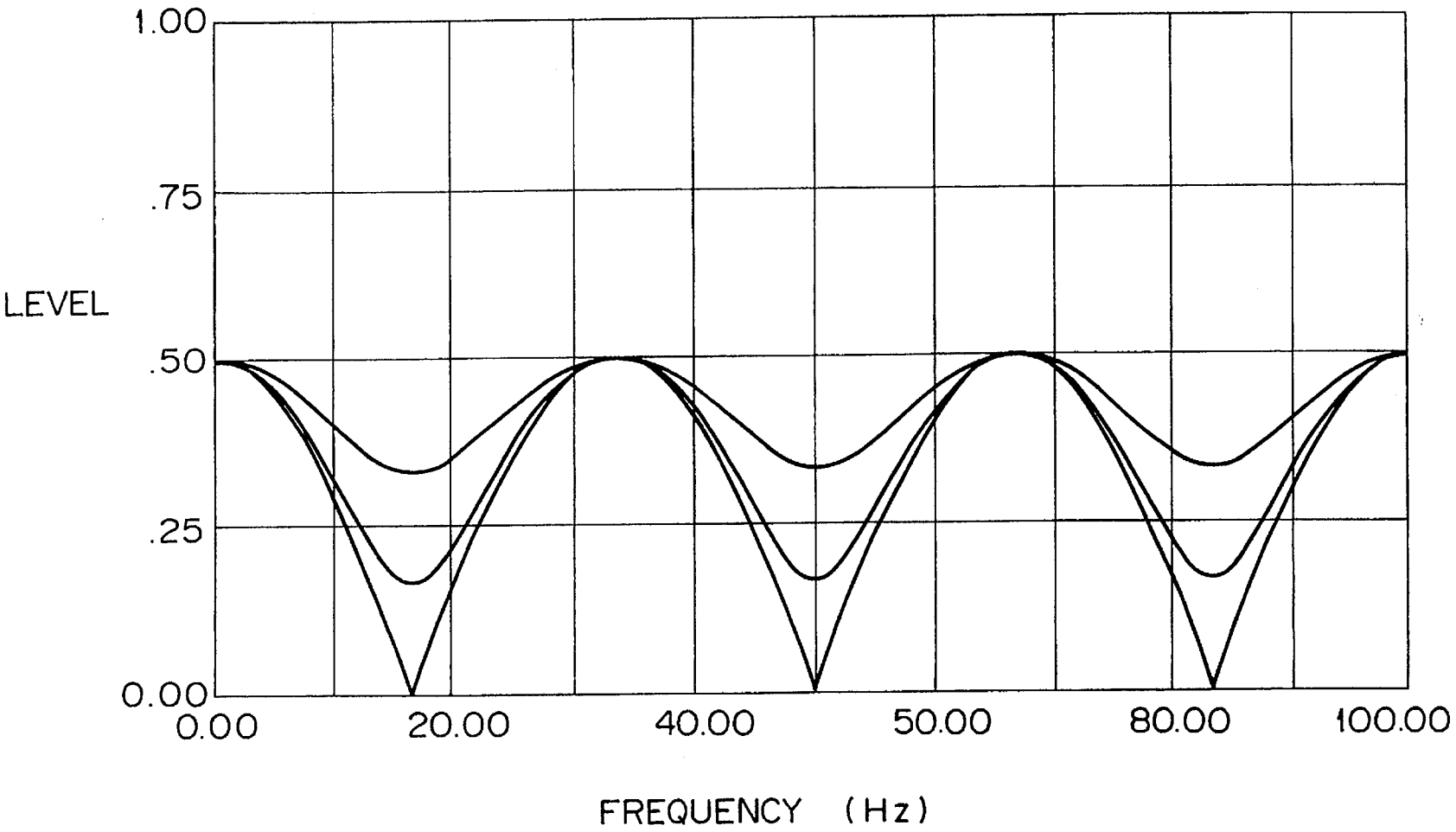
FIG. 2 is a graph showing a time-dependent change in the frequency response of the conventional pitch control apparatus during a cross-fade period.
Figure 3:
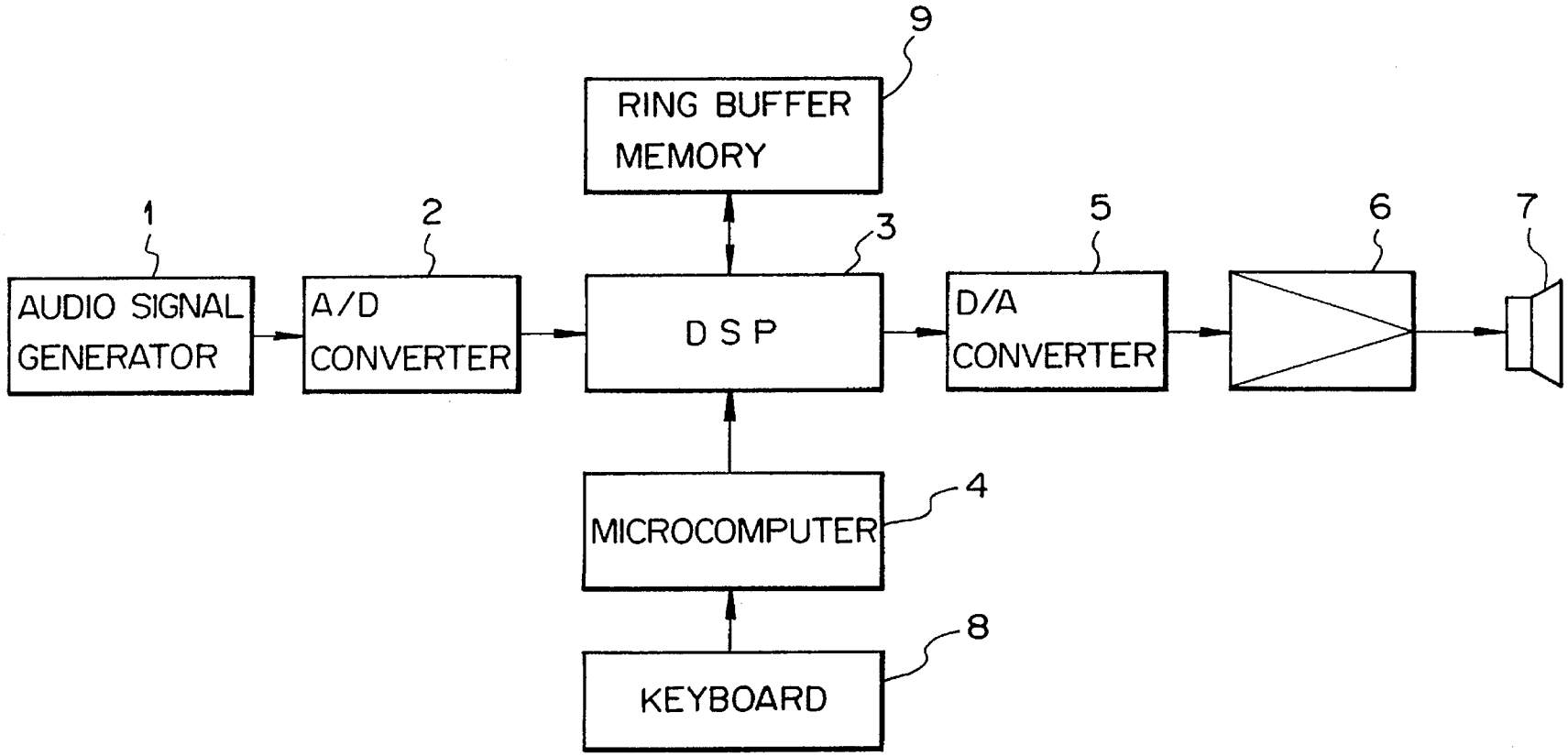
FIG. 3 is a block diagram illustrating a pitch control apparatus according to one embodiment of the present invention.

In a pitch control apparatus of the present invention in FIG. 3, an audio signal output from an analog audio signal generator 1, such as a tuner, tape deck, or a microphone, is sent to an A/D converter 2. The output terminal of the A/D converter 2 is connected to a DSP (Digital Signal Processor) 3. The DSP 3 whose structure will be described later is controlled by a microcomputer 4. A ring buffer memory 9 is connected to the DSP 3. The ring buffer memory 9 has memory positions of 3000 addresses (words) or more. The output terminal of the DSP 3 is connected to a D/A converter 5, where a digital audio signal from the DSP 3 is converted into an analog audio signal. A loudspeaker 7 is connected via a power amplifier 6 to the D/A converter 5. If a digital audio signal generator, such as a DAT, is used instead of the mentioned analog type, it is directly connectable to the DSP 3, without the A/D converter 2.

Figure 4:
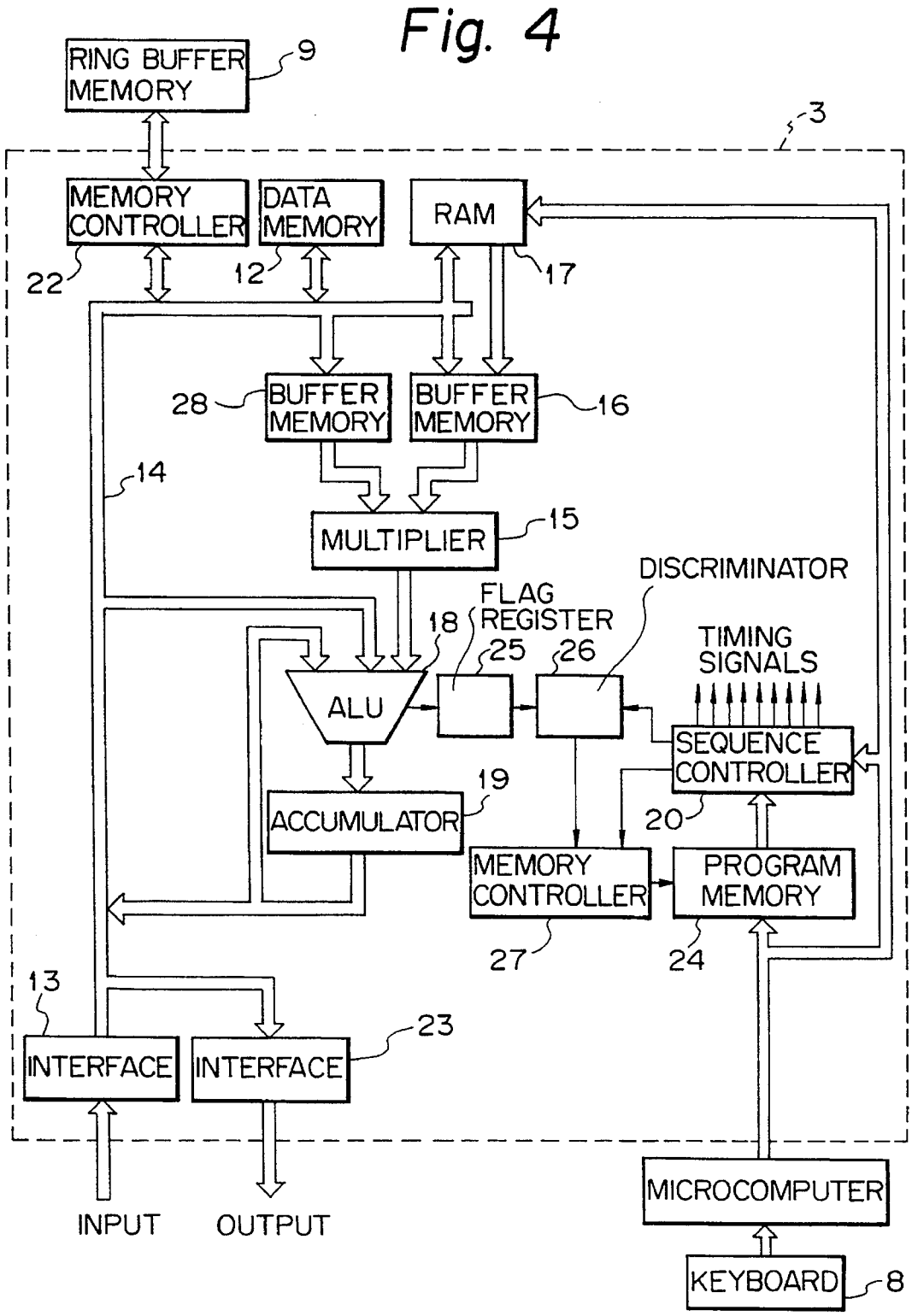
FIG. 4 is a schematic block diagram showing the structure of a DSP in the pitch control apparatus in FIG. 3.

FIG. 4 shows the schematic structure of the DSP 3. The digital signal from the A/D converter 2 is supplied to an input interface 13 in the DSP 3. The input interface 13 is connected to a data bus 14, which is connected to a data memory 12, buffer memories 16 and 28, and a coefficient RAM 17. The output terminal of the buffer memory 28 is connected to one of the input terminals of a multiplier 15. The output of the buffer memory 16 is connected to the other input terminal of the multiplier 15. The buffer memory 16 is connected to the coefficient RAM 17, where a plurality of pieces of coefficient data are stored. In response to a timing signal from a sequence controller 20 to be explained later, one piece of coefficient data is read out from a coefficient data group which is stored in the RAM 17, and then is sent to the buffer memory 16 to be held therein. The coefficient data held in the buffer memory 16 is supplied to the multiplier 15. An ALU (Arithmetic Logic Unit) 18 has two input terminals to which the calculation output from the multiplier 15 and the data bus 14 are respectively connected, and one other input terminal connected to the output of an accumulator 19 (to be described below). The ALU 18 adds the outputs of the multiplier 15 and the accumulator 19 together, or compares them with each other. The ALU 18 has its calculation output connected to the accumulator 19, which is in turn connected to the data bus 14. Also connected to the data bus 14 is a memory controller 22 which controls data writing and reading accesses to the ring buffer memory 9. A flag register 25 is connected to the ALU 18, and holds the result of a comparison/arithmetic operation done by the ALU 18. A discriminator 26 is connected to the flag register 25, and compares a flag held in the flag register 25 with data output from the sequence controller 20. The discrimination output from the discriminator 26 is supplied to a memory controller 27 which selects the reading address of a program memory 24. The memory controller 27 usually generates a reading address signal in a predetermined order, but outputs an address signal received from the sequence controller 20 as the reading address signal, depending on the discrimination output from the discriminator 9.

An output interface 23 is connected to the data bus 14. A digital audio signal of the output interface 23 is sent as the output signal of the DSP 3 to the D/A converter 5.

The sequence controller 20 controls operational timings for the interfaces 13 and 23, the multiplier 15, the coefficient RAM 17, the ALU 18, the accumulator 19 and the memory controllers 22 and 27. The sequence controller 20 functions in accordance with an operation program written in the program memory 24, as well as by a command from the microcomputer 4. A keyboard 8 is connected to the microcomputer 4 to enter various commands when operated. The microcomputer 4 controls the writing of the coefficient data in the RAM 17 in accordance with a key operation of the keyboard 8.

In the above-described arrangement, the analog audio signal to be sent to the A/D converter 2 is converted into a digital audio signal for every predetermined sampling cycle $T_0$, and is supplied via the interface 13 to the data memory 12 to be stored there. The sequence controller 20 controls timings, such as a timing for reading data from the interface 13, a timing for selectively transferring data from the data memory 12 to the multiplier 15, a timing for outputting each piece of coefficient data from the RAM 17, a multiplication timing for the multiplier 15, an addition timing for the ALU 18, an output timing for the accumulator 19, and a timing for outputting resultant data from the interface 23. The desired operation will be executed by the proper control of these timings. For example, the received audio signal data is supplied via the data bus 14 to the data memory 12 to be stored there. The signal data stored in the data memory 12 is sequentially read out, supplied to the memory controller 22, and written at the memory position in the ring buffer memory 9 which is a position designated by a writing address W. Data is read out at the memory position of the ring buffer memory 9 which is designated by a reading address $R_{Mn}$. The read data is supplied to the data memory 12 and stored there. Coefficients are stored in the RAM 17, and then are read out and supplied to the buffer memory 16 to be held there. The data stored in the data memory 12 is read out and sent to the buffer memory 28. The multiplier 15 multiplies data values held in the buffer memory 28 by the coefficients held in the buffer memory 16, and outputs the result. The data and variables stored in the data memory 12, and the data value or the multiplication result of the multiplier 15 are supplied to the ALU 18. The ALU 18 performs addition or comparison on the received data. The addition result is held in the accumulator 19, while the comparison result is held in the flag register 25. In accordance with the flag kept in the flag register 25, the reading address of the program memory 24 is skipped, and the step of the operation program of the sequence controller 20 is changed.

Figure 5:
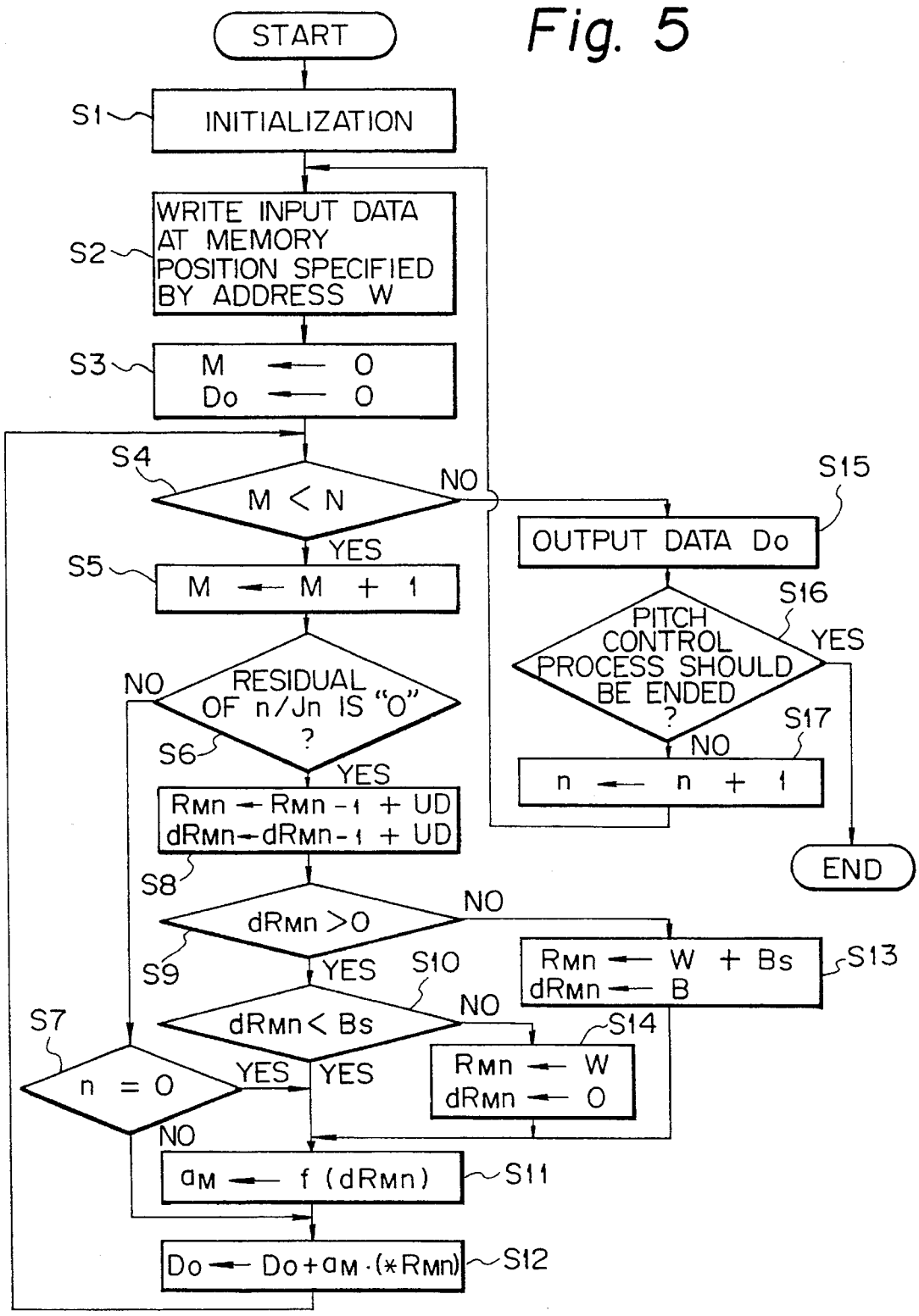
FIG. 5 is a flowchart showing the operation of the DSP.

The routine in FIG. 5 shows the specific operation of the DSP 3. First, a value UD is initialized by an entry through the keyboard 8, in accordance with a value Jn, a multiplier indicating how many times greater than the sampling cycle $T_0$ a cycle where reading of the sequential sampling data is skipped or such sampling data is read out twice should be, and an increase or decrease in a pitch (step S1). For example, UD is set to "1" to increase the pitch, while set to "−1" to decrease the pitch. Then, the input data is written at the memory position in the ring buffer memory 9 designated by the writing address W (step S2), to set the output data D0 and a variable M to "0" (step S3). The writing address W is incremented by "1" upon each increment of a variable n (for each sampling) in step S17 which will be described later. The variable M is used to set the reading address $R_{Mn}$. It is determined whether or not the variable M is smaller than the number of read points, N (step S4). The read point number N indicates the number of times data should be read out from the ring buffer memory 9 in the sampling cycle $T_0$. If M< N, the variable M is incremented by "1" (step S5), and it is determined if the residual of the division of the variable n by the multiplier Jn is "0" or not (step S6). If the residual is not "0," it is then determined whether or not the variable n is equal to "0" (step S7).

Figure 6:
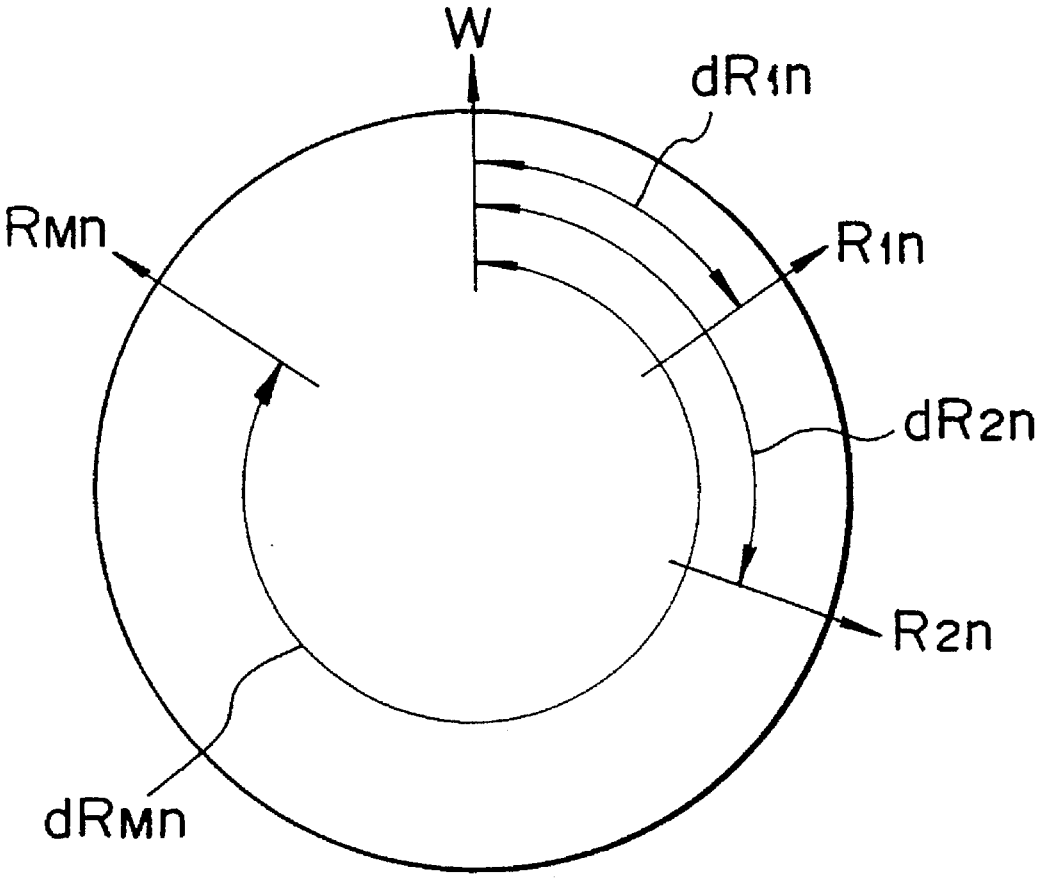
FIG. 6 is a diagram illustrating the positional relation between a writing address and reading address in a ring buffer memory in the pitch control apparatus.

If the residual of the division is "0," the value UD is added to a previous reading address $R_{Mn-1}$, yielding a current address $R_{Mn}$, and further the value UD is added to a previous value $dR_{Mn-1}$ of an address interval between the writing address W and the reading address $R_{Mn}$ to provide a current value $dR_{Mn}$ of the address interval (step S8). FIG. 6 shows the relation among the writing address W, the reading address $R_{Mn}$ and the address interval value $dR_{Mn}$ in the ring buffer memory 9. It is determined if the current address interval $dR_{Mn}$ is greater than "0" or not (step S9). If $dR_{Mn}>0$, it is determined whether or not value $dR_{Mn}$ is smaller than the total number of addresses, Bs, corresponding to the memory size of the ring buffer memory 9 (step S10). If $dR_{Mn}<$ Bs, a fade function ($dR_{Mn}$) determined by $dR_{MN}$ is calculated, and the resultant value is considered as a coefficient $a_M$ for data to be read out (step S11). Data ($*R_{Mn}$) is read out from the memory position specified by the reading address $R_{Mn}$, and is multiplied by the coefficient $a_M$, and output data $D_0$ is added to the resultant data to provide new output data $D_0$ (step S12). Any function is available as a fade function as long as it satisfies f(0)=0 and f(Bs)=0. For example, $f(dR_{Mn})$ is a linear function, or a function satisfying f(Bs/2)=1 and $f(Bs/4)=(1/2)^2$. If the addresses of the ring buffer memory 9 include 1 to Bs in step S8, the current address $R_{Mn}$ is "1" when the previous reading address $R_{Mn-1}$ is Bs. Data stored at the memory position specified by the reading address RMn is indicated as ($*R_{Mn}$).

If $dR_{Mn}<0$ in step S9, it means that the reading address $R_{Mn}$ is equal to the writing address W or the previous address by lowering the pitch. The total address number Bs is then added to the writing address W, and the resulting an address is set as the reading address RMn, and the total address number Bs is set as the address interval value $dR_{Mn}$ (step S13). Then, the flow goes to step S11. When UD=−1, $dR_{Mn}$ is not actually smaller than "0," but is equal to "0."

If $dR_{Mn}\geqq$Bs in step S10, it means that the reading address $R_{Mn}$ is equal to the writing address W or the following address by raising the pitch. An address equal to the writing address W is set as the reading address $R_{Mn}$, and "0" is set as the address interval value $dR_{Mn}$ (step S14). Then, the flow goes to step S11. When UD=1, $dR_{Mn}$ is not actually greater than Bs, but is equal to Bs.

When n is equal to "0" in step S7, it indicates data received by the first sampling, and the flow advances to step S11. When n is not "0," it indicates other data than the first sampling input data, and the flow advances to step S12.

If M≧N in step S4, since the data has been read out at the memory positions specified by the reading addresses by the read point numbers N to acquire the output data $D_0$, the output data $D_0$ is actually output (step S15). It is determined if the interval control process should be terminated or not (step S16). If this process should not be ended, the variable n is incremented by "1" (step S17), and the flow returns to step S2. If the interval control process should be ended, this routine will be terminated.

If the multiplier Jn for skipping data or reading data twice is "3" and the read point number N is "2", the reading address $R_{1n}$ and $R_{2n}$ are changed for every three sampling of the input data. To raise the pitch, the reading addresses $R_{1n}$ and $R_{2n}$ are advanced from the respective previous values $R_{1n-1}$ and $R_{2n-1}$ by the value UD. To lower the pitch, the reading addresses $R_{1n}$ and $R_{2n}$ are delayed from the respective previous value $R_{1n-1}$ and $R_{2n-1}$ by the value UD. A coefficient $a_1$ becomes the fade function $f(dR_{1n})$ determined by the value $dR_{1n}$ of the address interval between the reading address $R_{1n}$ and the writing address W. Data ($*R_{1n}$), which is read from the memory position indicated by the reading address $R_{1n}$, is multiplied by the coefficient $a_1$, and the output data $D_0$ (=0) is then added to the multiplication result to yield the output data $D_0$ ($=a_1(*R_{1n})$). A coefficient $a_2$ becomes the fade function $f(dR_{2n})$ defined by the value $dR_{2n}$ of the interval between the reading address $R_{2n}$ and the writing address W. Data ($*R_{2n}$), which is read from the memory position indicated by the reading address $R_{2n}$, is multiplied by the coefficient $a_2$, and the output data $D_0$ ($=a_1(*R_{1n})$) is then added to the multiplication result, yielding the output data $D_0$ ($=a_1(*R_{1n})+a_2(*R_{1n})$). The calculated output data $D_0$ is supplied via the interface 23 to the D/A converter 5.

If the reading addresses $R_{1n}$ and $R_{2n}$ have been advanced in order to raise the pitch and exceed the writing address W, so that the address interval value $dR_{1n}$ and $dR_{2n}$ are equal to or more than the total address number Bs, the reading addresses $R_{1n}$ and $R_{2n}$ are set equal to the writing address W. If the reading addresses $R_{1n}$ and $R_{2n}$ have been delayed to lower the pitch and become smaller than the writing address W, so that the address interval value $dR_{1n}$ and $dR_{2n}$ are equal to or smaller than "0," the reading addresses $R_{1n}$ and $R_{2n}$ are set equal to the value of the writing address W added to total address number Bs.

The address interval values $dR_{1n}$ and $dR_{2n}$ are not changed with respect to data entered during the two sequential sampling cycles where the above-described operation is executed. The coefficients $a_1$ and $a_2$ are therefore maintained, and the output data $D_0$ is calculated in the above manner, in accordance with the data ($*R_{1n}$) and ($*R_{2n}$) which are read out at the memory positions specified by the respective reading addresses $R_{1n}$ and $R_{2n}$.

With D being the address interval between a plurality of reading addresses, each time difference Td for data between the plurality of reading addresses (e.g., $R_{1n}$ and $R_{2n}$) when the pitch is to be raised can be expressed as follows.

$$Td=D.(1-(1/Jn))\cdot T_0 \quad (1)$$

When the pitch is to be lowered, Td can be expressed as follows.

$$Td=D.(1+(1/Jn))\cdot T_0 \quad (2)$$

As apparent from equations (1) and (2), the time Td is smaller when the pitch rises than when the pitch lowers as long as D and Jn is constant. It therefore understood that the reverberation phenomenon is more difficult to occur when the pitch increases than when the pitch decreases. Provided that Tdmax is an allowable time for the time difference Td of data, the maximum value Dmax in the address interval value D between a plurality of reading addresses can be expressed $$Dmax=Tdmax/\{(1-(1/Jn))\cdot T_0\} \quad (3)$$

from the equation (1), when the pitch is to be increased, and $$Dmax=Tdmax/\{(1+(1/Jn))\cdot T_0\} \quad (4)$$

from the equation (2) when the pitch is to be lowered.

The allowable time Tdmax is set 45 to 80 msec to prevent a reverberation phenomenon from becoming prominent.

For example, if the intervals between the plurality of reading addresses are identical, since the total address number Bs of the ring buffer memory 9 is N.Dmax, Bs is acquired by;

$$Bs=N.Tdmax/\{(1-(1/Jn))\cdot T_0\} \quad (5)$$

when the pitch is to be raised, and $$Bs=N.Tdmax/\{(1+(1/Jn))\cdot T_0\} \quad (6)$$

when the pitch is to be lowered.

It is therefore necessary to vary the total address number Bs of the ring buffer memory 9 in accordance with an increase or decrease of the pitch in order to suppress the reverberation phenomenon and a tremolo. If the total address number Bs of the ring buffer memory 9 is to be a fixed number, the total address number Bs has to be set in association with a musical tone which is most likely to cause the reverberation. For example, the pitch is supposed to be shifted up to two and half tones (five steps each in the increasing and decreasing directions). If the total address number Bs is fixed in this case, the time difference Td of data between the reading addresses becomes larger, as the amount of the pitch shift becomes smaller when the pitch is to be increased, or as the amount of the pitch shift becomes larger when the pitch is to be decreased. Further, the time difference Td is longer when the pitch lowers than when the pitch rises. The total address number Bs of the ring buffer memory 9 has only to be fixed so that the reverberation will not be disturbing when the pitch decreases by two and half tones. If the total address number Bs is to change in accordance with the increase and decrease of the pitch, Bs can be set in such a way that the reverberation is not so disturbing when the pitch becomes higher by a half tone and when the pitch becomes lower by two and half tones.

Although the interval controlling according to the above-described embodiment is done using the DSP, other devices than the DSP are also available. For example, a pitch control apparatus may comprise a plurality of latch circuits which hold data read out from a ring buffer memory, an arithmetic operation circuit which sets a coefficient according to the interval between each of the plurality of addresses and the writing address, a plurality of multipliers each of which multiplies output data from the associated latch circuit by a set coefficient, and an adder which adds output data from the multipliers together, in order to perform the interval control.

Figure 7:
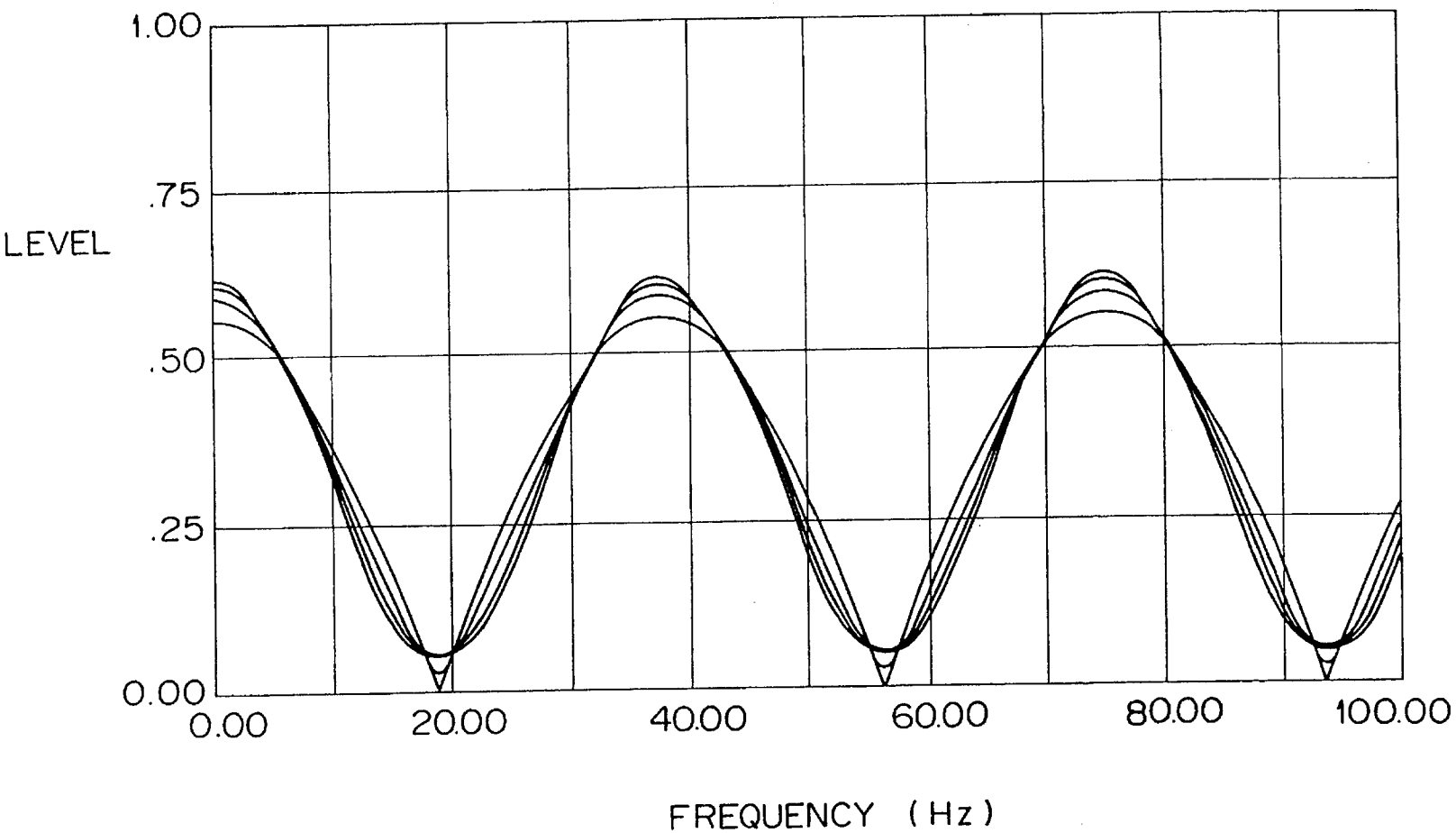
FIG. 7 is a graph showing a time-dependent change in the frequency response of the pitch control apparatus of the present invention during a cross-fade period.

As described above, according to the present invention, one writing address in a memory is designated in a predetermined order for every sampling cycle for an input audio signal data, the input audio signal data is written at the memory position at the designated writing address in the memory, a plurality of reading addresses of the memory are designated for every sampling cycle, and are set as addresses provided in a different order from the predetermined order for each cycle which is a multiple of the sampling cycle by a predetermined multiplier, data is read from the memory positions at the designated plurality of reading addresses in the memory, a coefficient is set in accordance with an address interval between the writing address and each of the designated plurality of reading addresses in the memory, and the pieces of data read from the plurality of reading addresses are multiplied by the associated coefficients, and the resultant data values are added together as output data. In other words, since the coefficient is set in accordance with the address interval between the writing address and each of the plurality of reading addresses, even though the values of data resulting from the multiplication of individual pieces of read data by the coefficients are added, thereby providing output data, a change in the time-dependent frequency response can be made smaller as shown in FIG. 7, suppressing the generation of a tremolo.

Furthermore, according to the second aspect of the present invention, when the allowable time for a time-dependent data shift between the plurality of reading addresses is Tdmax, the maximum value of an interval between each of the plurality of reading addresses, Dmax, is set as $$Dmax=Tdmax/\{(1-(1/Jn))\cdot T_0\},$$

when the pitch is to be raised, and set as $$Dmax=Tdmax/\{(1+(1/Jn))\cdot T_0\},$$

when the pitch is to be lowered, and the allowable time is set 45 to 80 msec, by which the reverberation will not be remarkably disturbing. It is therefore possible that the ring buffer memory has a large memory capacity to prevent the occurrence of tremolo tones and the reverberation phenomenon.

What is claimed is:

1. A pitch control apparatus comprising:

writing address designating means for designating a single writing address of a memory in a predetermined order for every sampling cycle for input audio signal data;

reading address designating means for designating a plurality of reading addresses of the memory for every said sampling cycle in which said single writing address is designated, and setting said plurality of reading addresses to have respective distances from said single writing address, said respective distances being changed for each cycle which is a multiple of said sampling cycle;

means for writing said input audio signal data at a memory position at said writing address designated in the memory;

means for reading data from memory positions at said plurality of reading addresses designated in the memory;

means for setting a coefficient in accordance with an address interval between the writing address and each of said plurality of reading addresses designated in the memory; and calculating means for multiplying data read out at said plurality of reading addresses by corresponding coefficients, and adding resultant data together, thereby forming output data.

2. A pitch control apparatus according to claim 1, wherein said memory comprises a ring buffer memory, and said writing address and reading address are designated to first addresses for starting therefrom after returning from final addresses.

3. A pitch control apparatus according to claim 1, wherein said reading address designating means designates an address, advanced by a predetermined number of addresses from a previous address which is specified according to said predetermined order, as said reading address, when the pitch is to be raised, and designates an address, delayed by said predetermined number of addresses from said previous address specified according to said predetermined order, as said reading address, when the pitch is to be lowered.

4. A pitch control apparatus according to claim 3, wherein said predetermined number of addresses is one address.

5. A pitch control apparatus according to claim 1, wherein said reading address designating means designates an address equal to said writing address as said reading address when said reading address becomes an address advanced by at least a total number of addresses in the memory when the pitch is to be raised, and designates an address equal to a result of addition of said writing address and said total number of addresses as said reading address when said reading address becomes an address delayed by said at least a total number of addresses when the pitch is to be lowered.

6. A pitch control apparatus according to claim 2, wherein said reading address designating means designates an address equal to said writing address as said reading address when said reading address becomes an address advanced by at least a total number of addresses in the memory when the pitch is to be raised, and designates an address equal to a result of addition of said writing address and said total number of addresses as said reading address when said reading address becomes an address delayed by said at least a total number of addresses when the pitch is to be lowered.

7. A pitch control apparatus comprising:

writing address designating means for designating a single writing address of a memory in a predetermined order for every sampling cycle $T_0$ for input audio signal data;

reading address designating means for individually designating a plurality of reading addresses of the memory in said predetermined order for every said sampling cycle $T_0$ in which said single writing address is designated, setting said plurality of reading addresses at addresses to have respective distances from said single writing address which are changed at least one sampling cycle $T_0$ after, when the pitch is to be raised, and setting said plurality of reading addresses to have respective distances from said single writing address which are changed at addresses at least one sampling cycle $T_0$ before when the pitch is lowered, for every cycle which is a multiple of the sampling cycle $T_0$ by a predetermined multiplier Jn, wherein Jn is an integer of at least 2;

means for writing said input audio signal data at a memory position at said writing address designated in the memory;

means for reading data from memory positions at said plurality of reading addresses designated in the memory;

means for setting a coefficient in accordance with an interval between said writing address and each of said plurality of reading addresses designated in the memory; and calculating means for multiplying data read out at the plurality of reading addresses by corresponding coefficients, and adding resultant data together, thereby forming output data; with an allowable time for a time-dependent data shift between said plurality of reading addresses being denoted by Tdmax, a maximum value of an interval between each of said plurality of reading addresses, Dmax, being set as $$Dmax-Tdmax/\{(1-1/Jn)\cdot T_0\},$$

when the pitch is to be raised and, set as $$Dmax=Tdmax/\{(1+1/Jn)\cdot T_0\},$$

when the pitch is to be lowered, and the allowed time being set to 45 to 80 msec.

8. A pitch control apparatus according to claim 7, wherein said memory comprises a ring buffer memory, and the writing address and reading address are designated from final addresses to first addresses to start therefrom.

* * * * *